United States Patent [19]

Thomas et al.

[11] 3,994,289

[45] Nov. 30, 1976

[54] ACUPRESSURE INSTRUMENT

[75] Inventors: John H. Thomas, Frankfort; Willis W. Kirkpatrick, Greentown, both of Ind.

[73] Assignee: The Scott & Fetzer Company, Lakewood, Ohio

[22] Filed: Nov. 17, 1975

[21] Appl. No.: 632,298

[52] U.S. Cl. ..... 128/57

[51] Int. Cl.[2] ..... A61H 15/00

[58] Field of Search ..... 128/57, 67–69, 128/24.3, 60

[56] References Cited

UNITED STATES PATENTS

| | | | |
|---|---|---|---|
| 2,074,735 | 3/1937 | Puttcamp | 128/67 |
| 2,079,096 | 5/1937 | Wilson | 128/57 |
| 2,104,429 | 1/1938 | Lipsner | 128/57 |

FOREIGN PATENTS OR APPLICATIONS

| | | | |
|---|---|---|---|
| 218,345 | 7/1924 | United Kingdom | 128/57 |

*Primary Examiner*—Lawrence W. Trapp

*Attorney, Agent, or Firm*—McNenny, Pearne, Gordon, Gail, Dickinson & Schiller

[57] ABSTRACT

An acupressure instrument for applying rolling pressure to the human body is disclosed. The instrument has an elongated handle provided with a roller having an axis of rotation in substantial axial alignment with the longitudinal axis of the handle. The roller has an hour-glass-like configuration with bulbous ends connected by a thin neck.

1 Claim, 2 Drawing Figures

Fig. 1
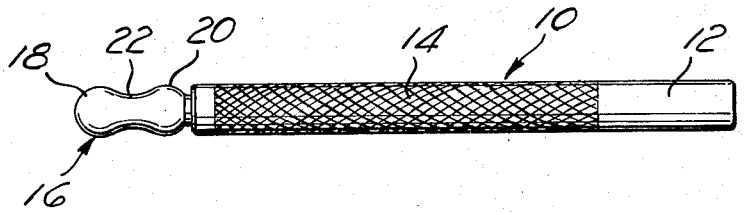
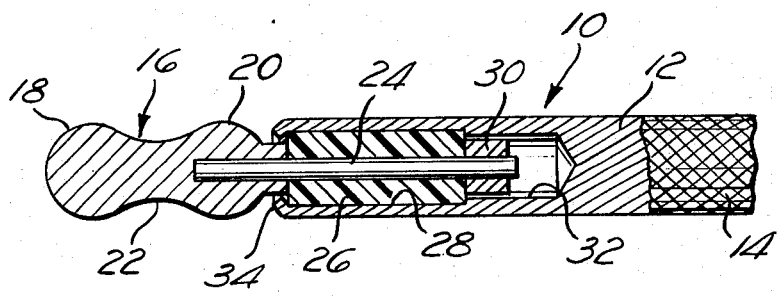
Fig. 2

ACUPRESSURE INSTRUMENT

BACKGROUND OF THE INVENTION

Acupuncture therapy has been employed for many centuries by the Chinese to relieve pain. More recently, acupuncture has been employed as an anesthetic for the reduction of pain during surgery. Acupuncturists have different thoughts on where to apply the needles. Some stimulate traditional acupuncture points; others use non-traditional points located in zones supplied by the same spinal chord segments; and still others use both techniques.

While acupuncture techniques are not universally accepted in this country, it is generally conceded that some benefits obtain from its use in many cases. It was reported by John J. Bonica, M.D., in the *Journal of the American Medical Association*, Vol. 229, No. 10, page, 1317, that acupuncture techniques are used as supplements to anesthesia during surgical operations. One of the advantages of acupuncture as an anesthetic is that the techniques are safe compared to some anesthetics which have serious side effects. Another advantage is that the technique is simple, convenient, inexpensive, and requires no elaborate equipment, thus permitting it to be used by paraprofessionals who do not have access to or training in drug anesthesia. This is particularly important in rural areas where there is a shortage of trained anesthesiologists. Among the disadvantages of acupuncture is the fact that while a highly trained person is not required, some training in anatomy is necessary to administer acupuncture. Therefore, self-treatment by an individual is generally not recommended.

Bonica further reports in the above-noted article that some hospitals in the People's Republic of China administer so-called "acupressure analgesia" to stimulate the acupuncture points. This is done by finger massage at the traditional or nontraditional acupuncture points, and results in comparable effects with respect to acupuncture, but it must be administered over long periods of time for the benefits to obtain. In view of this, it becomes practical for an individual to self-administer acupressure after having learned the proper acupressure points. A number of books have been written describing the location of those points, and one such book is *The Healing Benefits of Acupressure*, by F. M. Houston, published in 1974 by Keats Publishing, Inc.

Acupressure is performed today by employing the index finger, thumb, or palm, depending on the acupressure point to be stimulated, but there are some disadvantages in using the hand. One disadvantage is that tissues surrounding a sensitive area may become irritated not by the pressure but by frictional engagement with the finger. Furthermore, a therapist employing acupressure day after day on a series of patients finds that his fingers become very sore from applying pressure and from frictional contact with the tissues of the patient.

SUMMARY OF THE INVENTION

This invention overcomes the problems of fatigue on the part of the therapist and irritation on the part of the patient by providing an acupressure instrument which may be employed to apply the proper amount of pressure to the acupressure point with a rolling, rather than a sliding, frictional engagement. The instrument may be used by an untrained individual on himself without danger of harm and, when used properly, with some degree of therapeutic benefit. It should be noted, however, that the use of the instrument and the practice of acupressure do not cure a patient, but do in many cases relieve pain for extended periods of time.

The instrument includes an elongated handle having a roller member rotatably mounted at one end which has an axis of rotation in substantial axial alignment with the longitudinal axis of the handle. The roller has an hourglass-like configuration with a bulbous portion at its distal end and a bulbous portion at its other end, and those portions are connected by a thin neck which blends into the curvature of the portions. There is provided a curved recess between the bulbous portions so that the operator may "track" certain bone or muscle areas at the acupressure point. This permits a gentle, rolling massage at the area to be treated.

BRIEF DESCRIPTION OF THE DRAWING

FIG. 1 is an elevational view of an acupressure instrument according to this invention; and FIG. 2 is an enlarged, fragmentary view of the roller end of the instrument, partly in section.

DETAILED DESCRIPTION OF THE INVENTION

Referring now to the drawing, there is illustrated an acupressure instrument 10 according to the invention. The instrument 10 comprises an elongated handle 12 having a length and diameter such that the instrument can conveniently be grasped by the operator. According to a preferred aspect of the invention, the handle has a length of $3\frac{7}{8}$ in. and a diameter of 5/16 in. As an aid in handling the device, the handle 12 is provided with knurling 14. A roller member 16 is rotatably mounted at one end of the handle 12 and has an axis of rotation in substantial axial alignment with respect to the longitudinal axis of the handle. The roller member has an hourglass-like configuration, with a bulbous portion 18 at its distal end and a bulbuous portion 20 at its other end. The portions 18 and 20 are joined by a thin neck 22 which blends into the curvature of the portions 18 and 20.

Means are provided to rotatably mount the roller member 16 on the handle. To this end there is provided a pin 24 press-fitted into the other end of the roller member 16. The pin 24 is rotatably mounted in a cylindrical bearing 26 which is pressed into a counterbore 28 in the handle 12. A washer 30 is press-fitted onto a protruding end of the pin 24 and is received within a bore 32 in the handle. The roller and its mounting means are retained by spinning or crimping the open mouth of the counterbore 28 radially inwardly to form a retaining flange 34 which captures the bearing 26.

Since the roller member 16 is freely rotatable with respect to the handle 12, the roller member may be applied to an acupressure point and gently moved back and forth over the point during therapy. Moreover, the neck portion 22 ensures that the tool will not slip from a desired bone or muscle during the rolling treatment.

The invention is not restricted to the slavish imitation of each and every detail set forth above. Obviously, devices may be provided which change, eliminate, or add certain specific details without departing from the scope of the invention.

What is claimed is:

1. An acupressure instrument for applying rolling pressure to the human body at predetermined pressure points, comprising an elongated handle, a roller member, said roller member having an hourglass-like configuration, with a bulbous portion at its distal end and a bulbous portion at its other end, said portions being connected by a thin neck which blends into the curvature of said portions, means rotatably mounting the roller member at one end of the handle so that the axis of rotation of the roller member is in substantial alignment with the longitudinal axis of the handle, said mounting means comprising a pin projecting from said other end of said roller member, a bearing received in one end of said handle and being retained therein by a radially inwardly bent end portion of said handle, said pin extending through said bearing and having a washer fixed to its end to prevent the pin from being removed from the bearing.

* * * * *